US007669469B2

(12) United States Patent
Shammai et al.

(10) Patent No.: US 7,669,469 B2
(45) Date of Patent: Mar. 2, 2010

(54) METHOD AND APPARATUS FOR A CONTINUOUS DATA RECORDER FOR A DOWNHOLE SAMPLE TANK

(75) Inventors: Michael Shammai, Houston, TX (US); Francisco G. Sanchez, Houston, TX (US); James T. Cernosek, Missouri City, TX (US); Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/836,993

(22) Filed: Apr. 30, 2004

(65) Prior Publication Data

US 2004/0216521 A1 Nov. 4, 2004

Related U.S. Application Data

(60) Provisional application No. 60/467,673, filed on May 2, 2003.

(51) Int. Cl.
*E21B 49/08* (2006.01)
*E21B 47/06* (2006.01)

(52) U.S. Cl. ..... 73/152.23; 73/152.27; 73/152.51; 73/152.52; 73/152.53; 436/25

(58) Field of Classification Search ..... 73/152.55, 73/125.55, 152.28, 152.27, 152.29–152.33, 73/152.51–152.53, 152.58, FOR. 100; 324/333; 166/264; 250/255; 374/136; 436/25, 28; 702/11

See application file for complete search history.

(56) References Cited

U.S. PATENT DOCUMENTS 2,938,117 A * 5/1960 Schmidt ..... 250/255
3,611,799 A * 10/1971 Davis ..... 73/152.24
3,957,117 A 5/1976 Dale
3,997,298 A * 12/1976 McLafferty et al. ..... 422/70
4,425,810 A * 1/1984 Simon et al. ..... 73/863.11

(Continued)

FOREIGN PATENT DOCUMENTS

WO WO 02/093126 A2 11/2002

OTHER PUBLICATIONS

Douglas Skoog, Principles of Instrumental Analysis, 3rd Ed., Saunders College Publishing, 1985, pp. 727-731, 750, 791.*

*Primary Examiner*—Thomas P Noland
(74) *Attorney, Agent, or Firm*—Madan & Sriram, P.C.

(57) ABSTRACT

The present invention provides an apparatus and method for continuously monitoring the integrity of a pressurized well bore fluid sample collected downhole in an earth boring or well bore. The CDR continuous by measures the temperature and pressure for the down hole sample. Near infrared, mid infrared and visible light analysis is also performed on the small amount of sample to provide an on site analysis of sample properties and contamination level. The onsite analysis comprises determination of gas oil ratio, API gravity and various other parameters which can be estimated by a trained neural network or chemometric equation a flexural mechanical resonator is also provided to measure fluid density and viscosity from which additional parameters can be estimated by a trained neural network or chemometric equation. The sample tank is overpressured or supercharged to obviate adverse pressure drop or other effects of diverting a small sample to the CDR.

35 Claims, 3 Drawing Sheets

U.S. PATENT DOCUMENTS 4,739,654 A * 4/1988 Pilkington et al. ..... 73/152.24
4,950,844 A 8/1990 Hallmark et al.
5,083,124 A * 1/1992 Nordstrom ..... 340/853.1
5,228,345 A * 7/1993 Vales ..... 73/864.31
5,329,811 A 7/1994 Schultz et al.
5,448,477 A * 9/1995 Delatorre et al. ..... 702/6
5,622,223 A * 4/1997 Vasquez ..... 166/264
5,635,631 A * 6/1997 Yesudas et al. ..... 73/61.46
5,756,884 A * 5/1998 Moracchini et al. ..... 73/61.44
5,859,430 A 1/1999 Mullins et al.
6,263,730 B1 * 7/2001 Grande et al. ..... 73/152.28
6,334,489 B1 1/2002 Shwe et al.
6,467,544 B1 * 10/2002 Brown et al. ..... 166/264
6,474,152 B1 11/2002 Mullins et al.
6,507,401 B1 * 1/2003 Turner et al. ..... 356/436
6,538,576 B1 * 3/2003 Schultz et al. ..... 340/854.6
6,640,625 B1 11/2003 Goodwin
6,659,177 B2 * 12/2003 Bolze et al. ..... 166/264
6,688,390 B2 * 2/2004 Bolze et al. ..... 166/264
6,794,652 B2 * 9/2004 Walkow ..... 250/343
6,938,470 B2 * 9/2005 DiFoggio et al. ..... 73/152.24
7,036,362 B2 * 5/2006 Haddad et al. ..... 73/152.05
7,081,615 B2 * 7/2006 Betancourt et al. ..... 250/255
7,196,786 B2 * 3/2007 DiFoggio ..... 356/301
7,210,343 B2 * 5/2007 Shammai et al. ..... 73/152.28
2002/0178805 A1 * 12/2002 DiFoggio et al. ..... 73/152.55
2002/0194906 A1 * 12/2002 Goodwin et al. ..... 73/152.55
2003/0033866 A1 2/2003 Diakonov et al.
2003/0106995 A1 * 6/2003 Smith et al. ..... 250/282

* cited by examiner

METHOD AND APPARATUS FOR A CONTINUOUS DATA RECORDER FOR A DOWNHOLE SAMPLE TANK

CROSS REFERENCE TO RELATED APPLICATIONS

This patent application is related and claims priority from U.S. Provisional Patent Application Ser. No. 60/467,673 filed on May 2, 2003 entitled "A Method and Apparatus a Continuous Data Recorder for a Downhole Sample Tank," by M. Shammai et al.

BACKGROUND OF THE INVENTION

1. Field of the Invention

The present invention relates generally to the field of downhole sampling and in particular to the continuous measurement of parameters of interest and on site analysis for hydrocarbon samples after capture in a downhole sample chamber to insure the integrity of the sample until transfer to a laboratory for analysis of the sample.

2. Summary of the Related Art

Earth formation fluids extant in a hydrocarbon producing well typically comprise a mixture of oil, gas, and water. The pressure, temperature and volume of formation fluids in a confined space determine the phase relation of these constituents. In a subsurface formation, high well fluid pressures often entrain gas within the oil above the bubble point pressure. When the pressure is reduced, the entrained or dissolved gaseous compounds separate from the liquid phase sample. The accurate measure of pressure, temperature, and formation fluid composition from a particular well affects the commercial interest in producing fluids available from the well. The data also provides information regarding procedures for maximizing the completion and production of the respective hydrocarbon reservoir.

Certain techniques facilitate analysis of the formation fluids downhole in the well bore. U.S. Pat. No. 6,467,544 to Brown, et al. describes a sample chamber having a slidably disposed piston to define a sample cavity on one side of the piston and a buffer cavity on the other side of the piston. U.S. Pat. No. 5,361,839 to Griffith et al. (1993) disclosed a transducer for generating an output representative of fluid sample characteristics downhole in a wellbore. U.S. Pat. No. 5,329,811 to Schultz et al. (I 994) disclosed an apparatus and method for assessing pressure and volume data for a downhole well fluid sample.

Other techniques capture a well fluid sample for retrieval to the surface. U.S. Pat. No. 4,583,595 to Czenichow et al. (1986) disclosed a piston actuated mechanism for capturing a well fluid sample. U.S. Pat. No. 4,721,157 to Berzin (1988) disclosed a shifting valve sleeve for capturing a well fluid sample in a chamber. U.S. Pat. No. 4,766,955 to Petermann (1988) disclosed a piston engaged with a control valve for capturing a well fluid sample, and U.S. Pat. No. 4,903,765 to Zunkel (1990) disclosed a time delayed well fluid sampler. U.S. Pat. No. 5,009,100 to Gruber et al. (1991) disclosed a wireline sampler for collecting a well fluid sample from a selected wellbore depth, U.S. Pat. No. 5,240,072 to Schultz et al. (1993) disclosed a multiple sample annulus pressure responsive sampler for permitting well fluid sample collection at different time and depth intervals, and U.S. Pat. No. 5,322,120 to Be et al. (1994) disclosed an electrically actuated hydraulic system for collecting well fluid samples deep in a wellbore.

Temperatures downhole in a deep wellbore often exceed 300 degrees F. When a hot formation fluid sample is retrieved to the surface at 70 degrees F., the resulting drop in temperature causes the formation fluid sample to contract. If the volume of the sample is unchanged, such contraction substantially reduces the sample pressure. A pressure drop changes in the situ formation fluid parameters, and can permit phase separation between liquids and gases entrained within the formation fluid sample. Phase separation significantly changes the formation fluid characteristics, and reduces the ability to accurately evaluate the actual properties of the formation fluid.

To overcome this limitation, various techniques have been developed to maintain pressure of the formation fluid sample. U.S. Pat. No. 5,337,822 to Massie et al. (1994) pressurized a formation fluid sample with a hydraulically driven piston powered by a high-pressure gas. Similarly, U.S. Pat. No. 5,662,166 to Shammai (1997) disclosed a pressurized gas to charge the formation fluid sample. U.S. Pat. No. 5,303,775 (1994) and U.S. Pat. No. 5,377,755 (1995) to Michaels et al. disclose a bi-directional, positive displacement pump for increasing the formation fluid sample pressure above the bubble point so that subsequent cooling did not reduce the fluid pressure below the bubble point.

Due to the uncertainty of the restoration process, any pressure-volume-temperature (PVT) lab analyses that are performed on the restored sing-phase crude oil are suspect. When using ordinary sample tanks, one tries to minimize this problem of cooling and separating into two-phase by pressurizing the sample down hole to a pressure that is far (4500 or more psi) above the downhole formation pressure. The extra pressurization is an attempt to squeeze enough extra crude oil into the fixed volume of the tank that upon cooling to surface temperatures the crude oil is still under enough pressure to maintain a single-phase state and maintains at least at the pressure that it had downhole.

The gas cushion of the single-phase tanks, thus, makes it easier to maintain a sample in a single phase state because, as the crude oil sample shrinks, the gas cushion expands to keep pressure on the crude. However, if the crude oil shrinks too much, the gas cushion (which expands by as much as the crude shrinks) may expand to the point that the pressure applied by the gas cushion to the crude falls below formation pressure and allows asphaltenes in the crude oil to precipitate out or gas bubbles to form. Thus, there is a need to monitor the integrity of the sample from the time the sample is brought to the surface until it is delivered to the laboratory for analysis.

SUMMARY OF THE INVENTION

The present invention addresses the shortcomings of the related art described above. The present invention provides an apparatus and method for continuously monitoring the integrity of a pressurized well bore fluid sample collected downhole in an earth boring or well bore. Once a downhole sample is collected a continuous data recorder (CDR) device, attached to a down hole sample chamber, periodically measures the temperature and pressure for the down hole sample. Near infrared, mid infrared and visible light analysis is also performed on the sample to provide an on site analysis of sample properties and contamination level. The onsite analysis comprises determination of gas oil ratio, API gravity and various other parameters which can be estimated by a trained neural network or a chemometric equation. A flexural mechanical resonator is also provided to measure fluid density and viscosity from which additional parameters can be estimated by a trained neural network or chemometric equation. The sample tank is pressurized, charged or supercharged to obviate adverse pressure drop or other effects of diverting the sample to the CDR for analysis.

BRIEF DESCRIPTION OF THE FIGURES

For detailed understanding of the present invention, references should be made to the following detailed description of the exemplary embodiment, taken in conjunction with the accompanying drawings, in which like elements have been given like numerals, wherein.

DETAILED DESCRIPTION OF A EXEMPLARY EMBODIMENT

Figure 1:
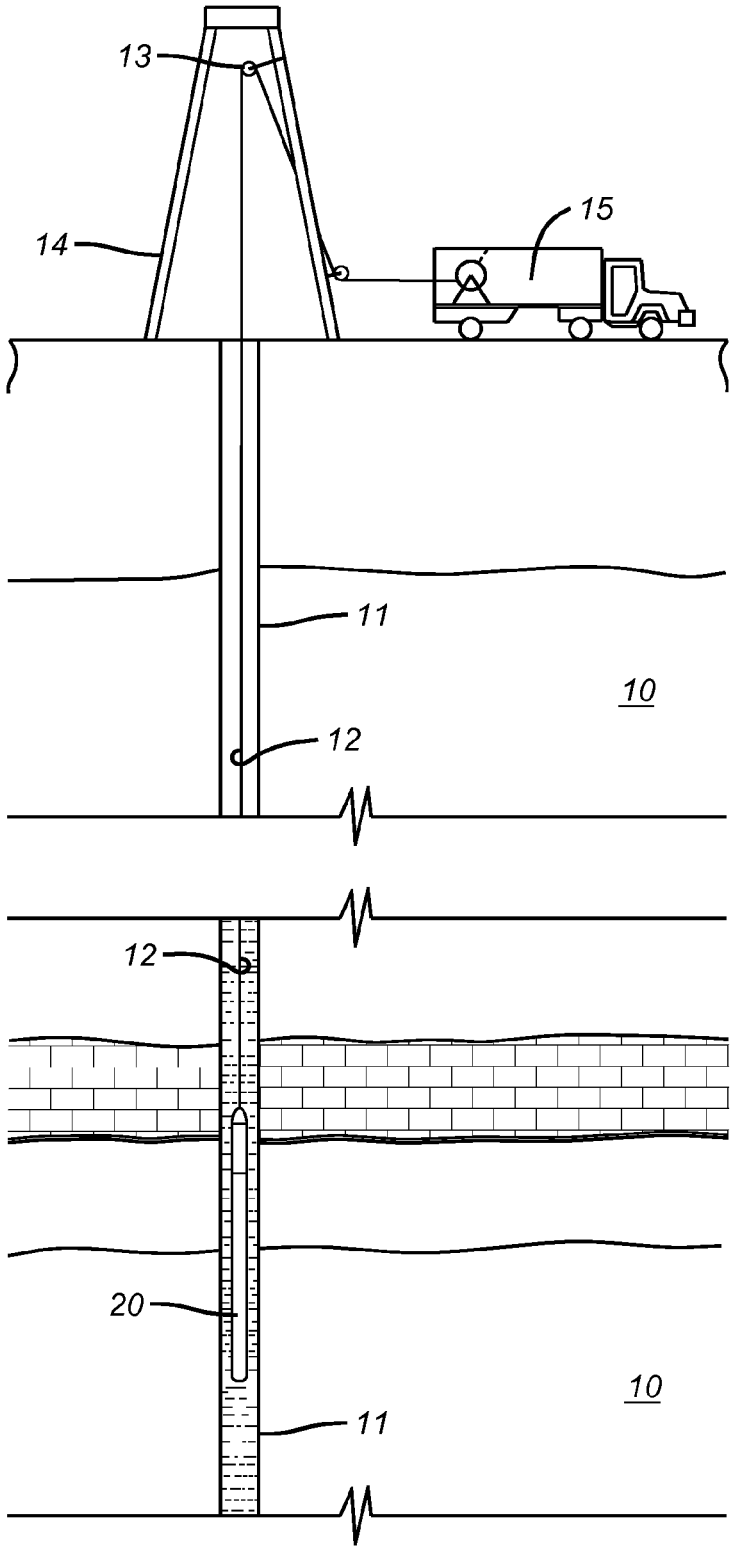
FIG. 1 is a schematic earth section illustrating the invention operating environment.

FIG. 1 schematically represents a cross-section of earth 10 along the length of a wellbore penetration 11. Usually, the wellbore will be at least partially filled with a mixture of liquids including water, drilling fluid, and formation fluids that are indigenous to the earth formations penetrated by the wellbore. Hereinafter, such fluid mixtures are referred to as "wellbore fluids". The term "formation fluid" hereinafter refers to a specific formation fluid exclusive of any substantial mixture or contamination by fluids not naturally present in the specific formation.

Suspended within the wellbore 11 at the bottom end of a wireline 12 is a formation fluid sampling tool 20. The wireline 12 is often carried over a pulley 13 supported by a derrick 14. Wireline deployment and retrieval is performed by a powered winch carried by a service truck 15.

Figure 2:
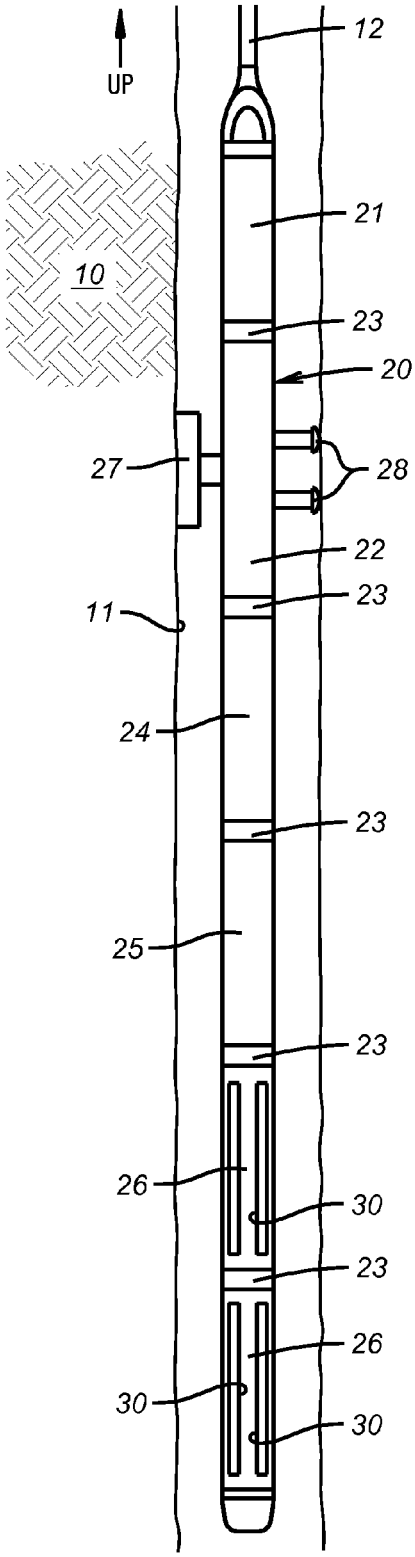
FIG. 2 is a schematic of the invention in operative assembly with cooperatively supporting tools.
Figure 3:
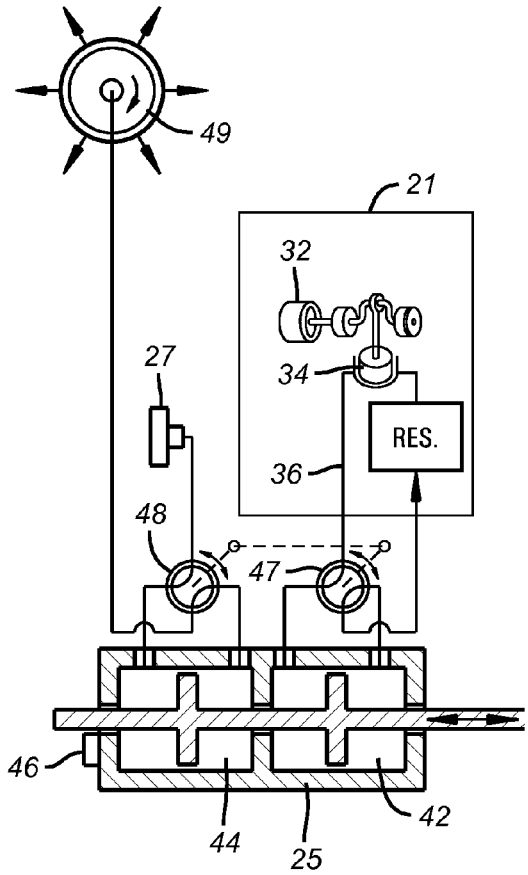
FIG. 3 is a schematic of a representative formation fluid extraction and delivery system.

Pursuant to the present invention, a exemplary embodiment of a sampling tool 20 is schematically illustrated by FIG. 2. Preferably, such sampling tools are a serial assembly of several tool segments that are joined end-to-end by the threaded sleeves of mutual compression unions 23. An assembly of tool segments appropriate for the present invention may include a hydraulic power unit 21 and a formation fluid extractor 23. Below the extractor 23, a large displacement volume motor/pump unit 24 is provided for line purging. Below the large volume pump is a similar motor/pump unit 25 having a smaller displacement volume that is quantitatively monitored as described more expansively with respect to FIG. 3. Ordinarily, one or more sample tank magazine sections 26 are assembled below the small volume pump. Each magazine section 26 may have three or more fluid sample tanks 30.

The formation fluid extractor 22 comprises an extensible suction probe 27 that is opposed by bore wall feet 28. Both, the suction probe 27 and the opposing feet 28 are hydraulically extensible to firmly engage the wellbore walls. Construction and operational details of the fluid extraction tool 22 are more expansively described by U.S. Pat. No. 5,303,775, the specification of which is incorporated herewith.

During the tank transportation of the sample tank contain a captured sample to the PVT laboratories or during sample transfer the transfer tank could be subjected to varying temperatures or pressures which results in pressure fluctuation in the tank. Therefore, obtaining a continuous recording of the pressure history of the sample is very important and valuable information. In an exemplary embodiment, a continuous data recorder (CDR) of the present invention is provided to accomplish this task. The CDR comprises a stainless steel chassis, electronic board to monitor and record pressure, temperature, other fluid parameters and a battery to power the electronics board. The CDR can be installed to record the sample pressure, temperature, and other fluid parameters downhole during the sampling, retrieval, sample transport, and sample transfer in a surface PVT Laboratory. The present invention provides data during the sample transportation to the laboratory. The data provided by the CDR is of great importance to the client and the sample service provider because, often mistakes and accidents occur during the transfer of the sample from the well bore location to the client, which render the very expensive sample useless for the solid deposition study. Clients do not want to pay for samples that have been spoiled by subjection to pressure and temperature variations. Such continuous data history enables the clients to evaluate their sample quality far more accurately and completely than ever before and identify the source of the problem.

The present invention solves the lack of data while the sample is being transferred from a downhole sample capture tank to another tank such as a laboratory analysis tank. During the transfer of the sample pressure preferably remain above the formation pressure at all times to ensure that the sample has not flashed into a two phase state. Preferably the pressure on the sample is also maintained above the pressure at which asphaltenes precipitate from the sample. Lack of proper equipment and personnel training often results in problems in sample transfer which had been ignored by the clients in the past. However, clients indicated great interest in acquiring relevant data history to properly evaluate this problem.

The present invention provides continuous temperature pressure and other fluid parameter readings for the sample from downhole capture to laboratory transfer of the sample from the sample tank for laboratory analysis. This data is preferably recorded periodically, e.g., 10 times per minute, for up to one week however, the recording period can be extended. A plot of recorded variables versus time is presented to the client showing the pressure, temperature and other fluid parameters history for the sample.

The present invention enables examination of the reservoir fluid properties without compromising an entire sample. One of the major difficulties that the service companies face with regard to any onsite analysis is sample restoration. If the sample is not thoroughly restored then any sub-sample removed for onsite analysis will change the over all composition of the original sample. The restoration process is either impossible or often a very lengthy 6-8 hour job depending on the sample composition.

This invention presents a simple but effective method to not only provide much needed pressure, temperature and other fluid parameter data history but to provide preliminary onsite PVT and additional analysis. The present invention provides much needed independent time plots (pressure and temperature) during the sample restoration and also provides data during the sample transfer.

The present invention enables clients to isolate the PVT lab mistakes that could result in loss of sample quality from the performance of the sample service performed in the field. Therefore, the present invention enables a sample service provider to do a much more effective job in trouble shooting and mitigating the sampling problems.

Figure 4:
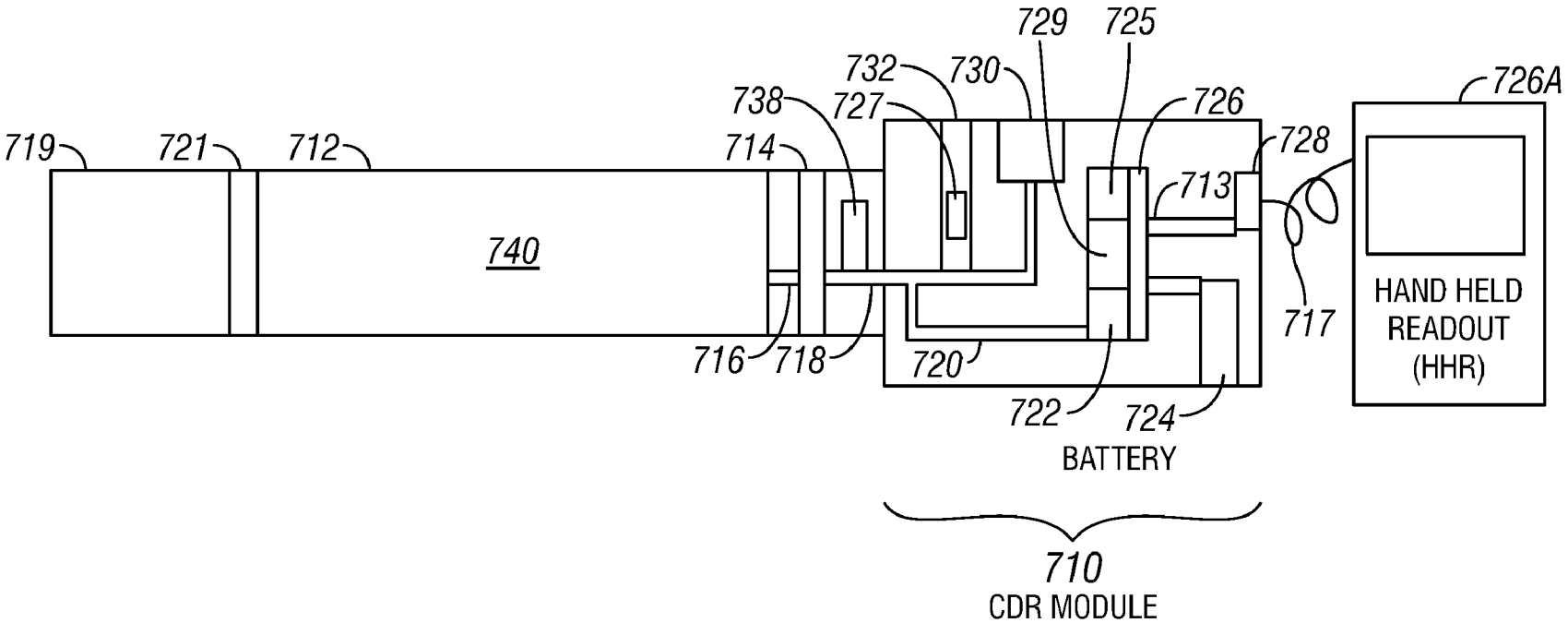
FIG. 4 is an illustration of a exemplary embodiment of the continuous data recorder module of the present invention.

Turning now to FIG. 4, an exemplary embodiment of the invention is shown. In an exemplary embodiment a CDR 710 module is attached to a department of transportation (DOT) approved downhole sample tank 712. Thus, the DOT sample tank and CDR can be transferred together to the client or laboratory thereby providing a continuous history of the sample properties of interest. As described above, the sample is supercharged or pressure is applied to the sample so that the sample is maintained above formation pressure. The CDR module 710 comprises a primary manual valve 714, a connection 716 between the single phase tank 712 and the primary manual valve 714. The CDR module further comprises on site analysis module 738 comprising a near infrared/mid infrared (NIR/MIR) and visible light analysis module 738 (not shown in detail), a processor 726 (not shown in detail), and flexural mechanical resonator 727 (not shown in detail). The CDR further comprises a secondary manual valve 732, sample transfer port 730, pressure gauge 722 (not shown in detail), and recorder 725 (not shown in detail), electrical connection 713, and data transfer port 728. In an exemplary embodiment the CDR 710 is attached to the DOT single phase supercharged or pressurized pressure tank 712. In a exemplary embodiment, the CDR 710 is attached to the sample tank, creating fluid communication between the CDR module primary manual valve 714 and the fluid sample 740. Fluid sample 740 is supercharged or over pressured by a pressure pump or supercharge device 719 placed behind sample tank piston 721, preferably to keep sample 740 above the formation pressure. A small portion of the fluid sample 740 enters fluid path 716 between the closed primary manual valve 714 and fluid sample 740. When the primary manual valve 714 is opened, sample fluid enters fluid path 718 between open primary manual valve 714 and closed secondary manual valve 732.

A hand held read out 726A is connected to CDR module 710 via wires 717. The closed secondary manual valve 732 traps a portion of the fluid sample remains in fluid path 718, however, the sample fluid is in communication with pressure gauge 722 and recorder 725 via bypass 720. Battery 724 provides power to the CDR electronics comprising the pressure gauge 722, recorder 725 and on site analysis module 738.

Temperature and pressure are measured by temperature gauge 729 (not shown in detail) and pressure gauge 722 (not shown in detail) and recorded by recorder 725 (not shown in detail). The hand held readout 726A is then disconnected and the primary manual valve 714 closed, isolating a portion of the fluid sample between the primary manual valve and the secondary manual valve. The secondary manual valve can be opened to enable hook up to onsite equipment via the sample transfer port 730. On site analysis module 738 comprises equipment to perform NIR/MIR/visible light analysis to evaluate the integrity of the sample on site or on a continuous basis. NIR/MIR/visible light analysis are described in co-owned U.S. patent application Ser. No. 10/265,991, which is incorporated herein by reference in its entirety. Thus, the CDR provides a continuous recording of a parameter of interest for the sample. The parameter of interest comprises the sample pressure, temperature and NIR/MIR/visible light historical analysis and is continuously recorded for the sample. On site analysis module 738 further comprises a flexural mechanical resonator 727 as described in co-owned U.S. patent application Ser. No. 10/144,965, which is incorporated herein by reference in its entirety. The CDR will read the pressure, temperature and NIR/MIR/visible light analysis data at a present frequency (⅕ mm or 1/10 mm) and save it in the memory. Once the CDR is connected the protective covers are placed on the tank which is now is ready for transportation to a PVT laboratory.

The CDR can also be connected at the surface prior to descending down hole for providing fluid communication between the CDR and the fluid sample down hole. In this configuration the pressure, temperature and NIR/MIR/visible analysis data can be recorded down hole prior to sampling, during sampling, during the ascension of the sample to the surface and during transportation of the sample to the laboratory so that a continuous data recording is provided for the entire life of the sample.

In another embodiment, the method of the present invention is implemented as a set computer executable instructions on a computer readable medium, comprising ROM, RAM, CD ROM, Flash or any other computer readable medium, that when executed cause a computer to implement the method of the present invention.

While the foregoing disclosure is directed to the exemplary embodiments of the invention various modifications will be apparent to those skilled in the art. It is intended that all variations within the scope of the appended claims be embraced by the foregoing disclosure. Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

The invention claimed is:

1. An apparatus for monitoring a parameter of interest for a formation fluid sample, comprising:

a wireline;

a downhole sample chamber containing a formation fluid sample; and a monitoring module configured to detachably connect to the downhole sample chamber and including a fluid path configured to receive a portion of the formation fluid sample from the downhole sample chamber for monitoring the parameter of interest for the formation fluid sample, the portion of the formation fluid flowing from the downhole sample chamber to the monitoring module, wherein the downhole sample chamber is configured to be conveyed into a wellbore without the monitoring module and wherein the monitoring module is configured to monitor the parameter of interest; and a sensor in communication with a portion of the formation fluid sample being retained in the fluid path; and wherein no sensor is in communication with the formation fluid sample while the downhole sample chamber is in the wellbore.

2. The apparatus of claim 1, further comprising one of: a temperature gauge for measuring a temperature of the fluid sample and a pressure sensor for measuring the pressure of the fluid sample.

3. The apparatus of claim 1, further comprising:

a recorder for recording the parameter of interest for the fluid sample.

4. The apparatus of claim 3, wherein the monitoring module includes a processor configured to record the parameter of interest periodically.

5. The apparatus of claim 1, further comprising:

an analysis module for performing analysis for the fluid sample to determine a first parameter of interest for the fluid sample.

6. The apparatus of claim 5, wherein the analysis module further comprises a light analysis system.

7. The apparatus of claim 5, wherein the analysis module further comprises a flexural mechanical resonator.

8. The apparatus of claim 5, further comprising:

a neural network for estimating a second parameter of interest for the fluid sample from the first parameter of interest for the fluid sample.

9. The apparatus of claim 5, further comprising:

a processor configured to process a chemometric equation to estimate a second parameter of interest for the fluid sample from the first parameter of interest for the fluid sample.

10. The apparatus of claim 1, wherein the fluid path includes:

a sample port conveying the formation fluid sample from a valve.

11. The apparatus of claim 1, wherein the monitoring module can be disconnected from the downhole sample chamber without disturbing the formation fluid sample in the downhole sample chamber, and wherein the fluid path in the monitoring module is configured to trap the formation fluid sample portion in the monitoring module.

12. The apparatus of claim 1 further comprising a sample tank in which the sample chamber is formed and wherein the monitoring module connects to an external surface of the sample tank, and wherein the sample tank is configured to be deployed into the wellbore without the monitoring module connected thereto.

13. The apparatus of claim 1 further comprising a sample tank in which the sample chamber is formed and wherein the valve is positioned in the sample tank.

14. A method for monitoring a parameter of interest for a fluid sample comprising:

conveying a downhole sample chamber into a wellbore without any monitoring module;

capturing the formation fluid sample downhole in the downhole sample chamber;

retrieving the downhole sample chamber to the surface;

connecting a detachable monitoring module to the downhole sample chamber;

receiving a portion of the fluid sample from the downhole sample chamber into a fluid path of the monitoring module; and monitoring the parameter of interest for the fluid sample with a sensor in communication with a retained portion of the received formation fluid sample in the monitoring module at the surface.

15. The method of claim 14, further comprising:

separating the portion of the fluid sample from the downhole sample chamber between at least two valves in a fluid path in the monitoring module.

16. The method of claim 14, further comprising:

monitoring one of pressure and temperature of the fluid sample.

17. The method of claim 14, further comprising:

recording a parameter of interest for the fluid sample.

18. The method of claim 17, further comprising recording the parameter of interest periodically.

19. The method of claim 14, further comprising:

performing an analysis for the fluid sample to determine a first parameter of interest for the fluid sample.

20. The method of claim 19, wherein performing the analysis further comprises performing a light analysis.

21. The method of claim 19, wherein performing the analysis further comprises performing a flexural mechanical resonator analysis.

22. The method of claim 19, further comprising:

estimating a second parameter of interest for the fluid sample from the first parameter of interest for the fluid sample using a neural network.

23. The method of claim 19, further comprising:

estimating a second parameter of interest for the fluid sample from the first parameter of interest for the fluid sample using a chemometric equation.

24. The method of claim 14, further comprising:

trapping the portion of the formation fluid sample in the monitoring module after coupling the monitoring module to the sample chamber and after the formation fluid sample is captured in the sample chamber; and monitoring the formation fluid sample only after the sample chamber has been retrieved to a surface location.

25. A computer readable medium containing computer executable instructions contained in a computer program that when executed by a computer perform a method for monitoring a parameter of interest for a fluid sample that has been separated from a fluid sample in a sample chamber, the computer program comprising:

a set of instructions for operating a monitoring module having a fluid path configured to receive the separated portion of the fluid sample and a sensor to monitor the parameter of interest for a retained portion of the received fluid sample after the sample chamber has collected the fluid sample in the sample chamber downhole and the sample chamber has been retrieved from downhole; and a set of instructions for operating the sensor.

26. The medium of claim 25, further comprising:

a set of instructions for monitoring pressure of the fluid sample by receiving pressure data and outputting the pressure data.

27. The medium of claim 25, further comprising:

a set of instructions for monitoring temperature of the fluid sample by receiving temperature data and outputting the temperature data.

28. The medium of claim 25, further comprising:

a set of instructions for recording a parameter of interest for the fluid sample after receiving data relating to the parameter of interest.

29. The medium of claim 28, further comprising a set of instructions for recording the parameter of interest periodically.

30. The medium of claim 25, further comprising:

a set of instructions for performing analysis for the fluid sample to determine a first parameter of interest for the fluid sample by receiving and processing data relating to the parameter of interest.

31. The medium of claim 30, wherein the set of instructions for performing analysis further comprises a set of instructions for performing a light analysis for determining the parameter of interest for the fluid sample.

32. The medium of claim 30, wherein the set of instructions for performing analysis further comprises a set of instructions for performing a flexural mechanical resonator analysis for determining the parameter of interest for the fluid sample.

33. The medium of claim 30, further comprising:

a set of instructions for estimating a second parameter of interest for the fluid sample from the first parameter of interest for the fluid sample using a neural network.

34. The medium of claim 30, further comprising:

a set of instructions for estimating a second parameter of interest for the fluid sample from the first parameter of interest for the fluid sample using a chemometric equation.

35. A method for monitoring a parameter of interest for a fluid sample comprising:

conveying a downhole sample chamber into a wellbore without any monitoring module;

capturing the formation fluid sample downhole in the downhole sample chamber;

retrieving the downhole sample chamber to the surface;

receiving a portion of the fluid sample from the downhole sample chamber into a monitoring module that is detachably connected to the downhole sample chamber; and disconnecting the downhole sample chamber from the monitoring module after trapping the portion of the formation fluid sample in the monitoring module while maintaining the pressure of the formation fluid sample in the downhole sample chamber.

* * * * *